US009050599B2

(12) United States Patent
Livermore

(10) Patent No.: US 9,050,599 B2
(45) Date of Patent: Jun. 9, 2015

(54) PORTABLE CRUSHING APPARATUS

(76) Inventor: Gary M Livermore, Bullhead City, AZ (US)

( * ) Notice: Subject to any disclaimer, the term of this patent is extended or adjusted under 35 U.S.C. 154(b) by 205 days.

(21) Appl. No.: 13/407,564

(22) Filed: Feb. 28, 2012

(65) Prior Publication Data

US 2012/0217329 A1 Aug. 30, 2012

Related U.S. Application Data

(60) Provisional application No. 61/447,099, filed on Feb. 28, 2011.

(51) Int. Cl.

| | |
|---|---|
| ***B02C 1/00*** | (2006.01) |
| ***B02C 1/02*** | (2006.01) |
| ***B02C 21/02*** | (2006.01) |
| ***B02C 1/04*** | (2006.01) |

(52) U.S. Cl.
CPC .. *B02C 1/04* (2013.01); *B02C 21/02* (2013.01)

(58) Field of Classification Search
CPC ..... B02C 1/02; B02C 1/04; B02C 1/10
USPC ..... 241/101.73–101.78, 262–266; 100/94, 100/98 R, 265, 293, 902
See application file for complete search history.

(56) References Cited

U.S. PATENT DOCUMENTS

| | | | | |
|---|---|---|---|---|
| 3,850,364 | A * | 11/1974 | Robbins | 241/51 |
| 3,894,698 | A * | 7/1975 | Falk | 241/264 |
| 4,899,942 | A * | 2/1990 | Bohringer | 241/200 |
| 5,172,869 | A * | 12/1992 | Kitsukawa et al. | 241/264 |
| 5,379,951 | A * | 1/1995 | Hughes | 241/60 |
| 6,517,019 | B2 * | 2/2003 | Johnson et al. | 241/186.4 |
| 6,641,068 | B2 * | 11/2003 | Ostergaard | 241/268 |
| 6,668,712 | B1 * | 12/2003 | Gervais | 100/100 |
| 7,143,970 | B2 * | 12/2006 | Ha | 241/268 |
| 2005/0116076 | A1 * | 6/2005 | Went | 241/291 |

* cited by examiner

*Primary Examiner* — Faye Francis
*Assistant Examiner* — Onekki Jolly
(74) *Attorney, Agent, or Firm* — Michael Ries

(57) ABSTRACT

A portable crushing apparatus to crush and grind small rocks and ores that includes a plurality of support legs that raise and stabilize the apparatus, a pair of handles that are perpendicular to the apparatus and allow a user to grasp the apparatus while in use and a pair of arms that include a distal end on each arm and extend horizontally from the apparatus. The apparatus also includes a casing that houses a crushing assembly that includes an adjustable jaw, a movable jaw, a plurality of jaw teeth, a plurality of spacers, an adjustable jaw pin, a guide pin, a pivot pin, a movable jaw spacer, an adjuster bracket and an adjusting bolt that is housed within the casing and a cover to prevent flying debris.

57 Claims, 6 Drawing Sheets

PORTABLE CRUSHING APPARATUS

This application claims priority to U.S. Provisional Application 61/447,099 filed on Feb. 28, 2011, the entire disclosure of which is incorporated by reference.

TECHNICAL FIELD & BACKGROUND

The present invention generally relates to a crushing apparatus. More specifically, the invention is a portable crushing apparatus that is typically utilized to crush small rocks and ores.

It is an object of the invention to provide a portable crushing apparatus that is hand-operated and portable and can be utilized in the field where there is no electricity or fuel to operate the portable crushing apparatus.

It is an object of the invention to provide a portable crushing apparatus that has the ability to crush relatively small rocks and ores and can grind the small rocks and ores to an approximate minus 20 mesh in three or less passes through the portable crushing apparatus.

It is an object of the invention to provide a portable crushing apparatus that is relatively lightweight and can be packed and transported to a relatively remote area typically where ore discovery is allowed.

What is really needed is a portable crushing apparatus that is hand-operated and portable and can be utilized in the field where there is no electricity or fuel to operate the portable crushing apparatus that has the ability to crush relatively small rocks and ores and can grind the small rocks and ores to an approximate minus 20 mesh in three or less passes through the portable crushing apparatus that is relatively lightweight and can be packed and transported to a relatively remote area typically where ore discovery is allowed.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
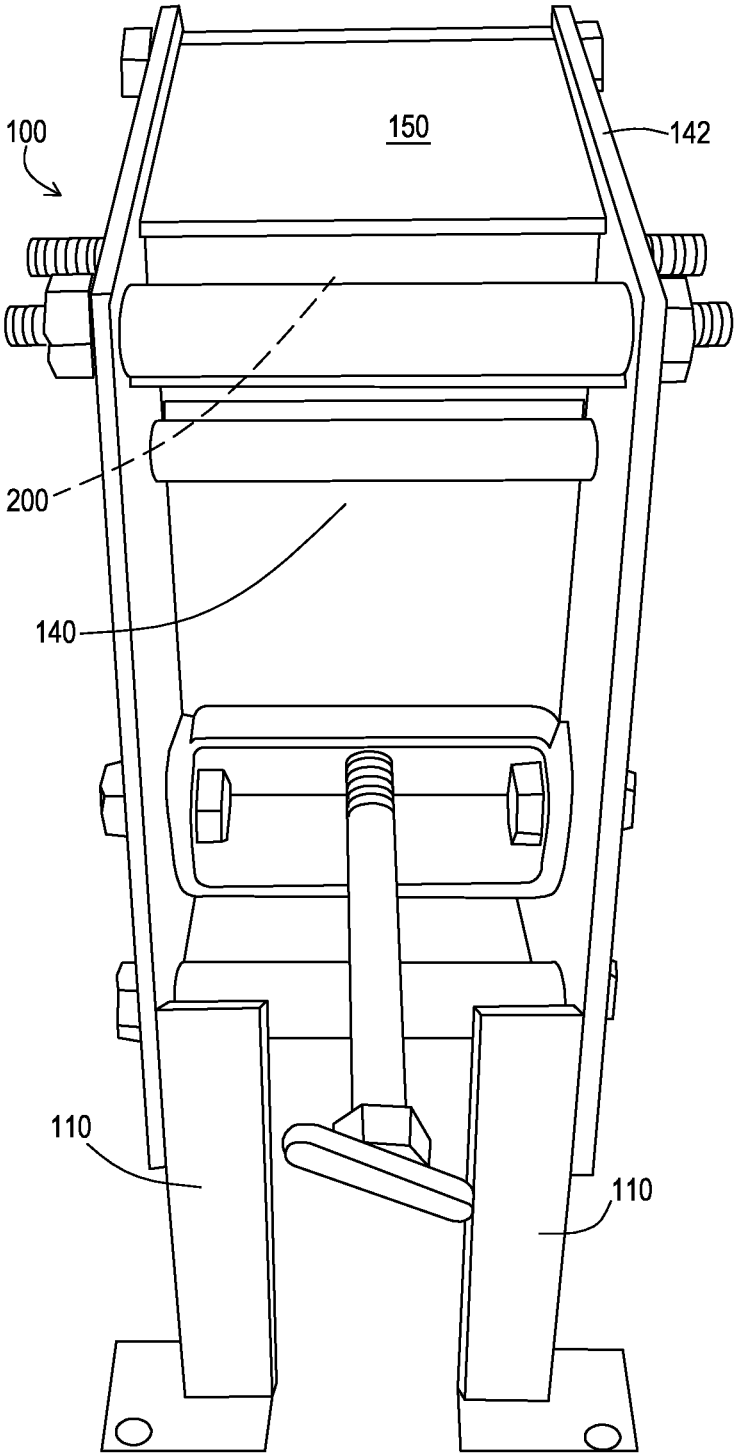
FIG. 1A illustrates a front view of a portable crushing apparatus, in accordance with one embodiment of the present invention.
Figure 1B:
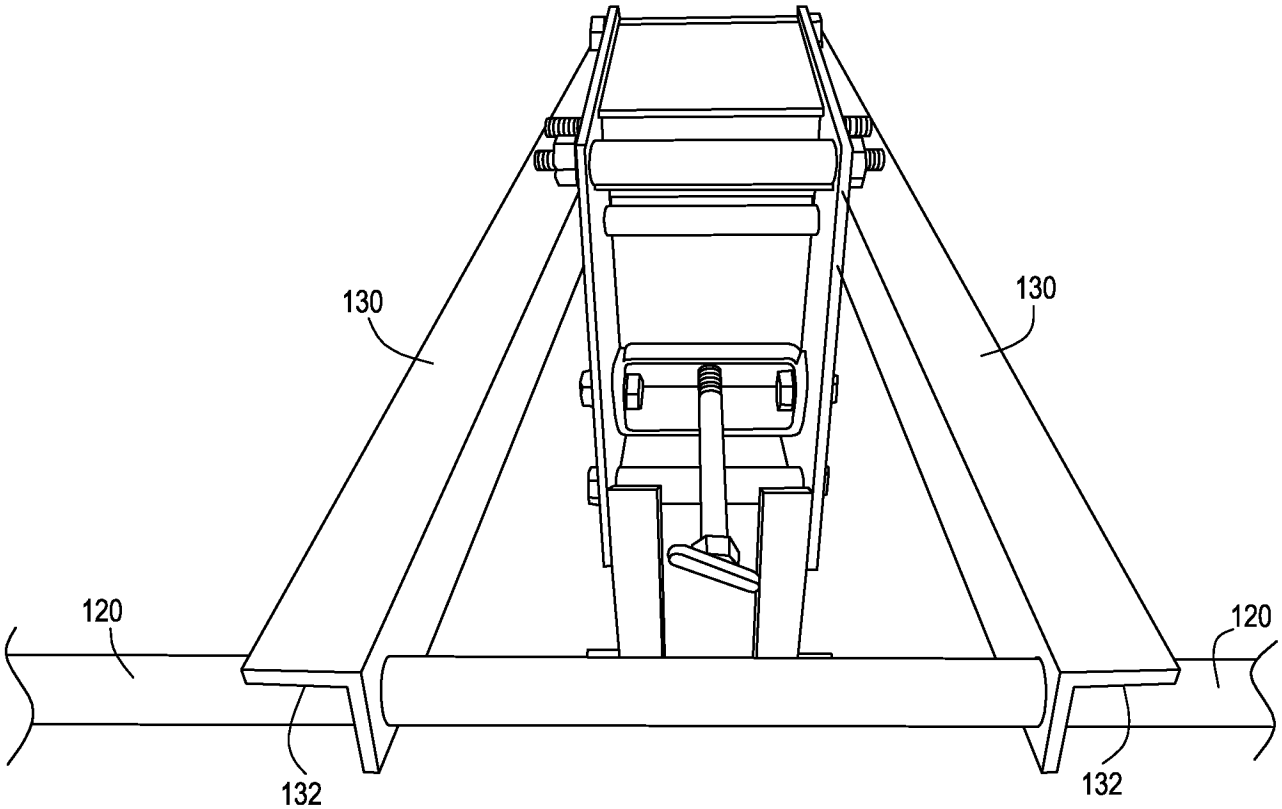
FIG. 1B illustrates a front view of a portable crushing apparatus, in accordance with one embodiment of the present invention.

FIG. 1A illustrates a front perspective view of a portable crushing apparatus 100, in accordance with one embodiment of the present invention. The portable crushing apparatus 100 illustrated in FIG. 1A is raised and stabilized by a plurality of support legs 110. FIG. 1B illustrates a front view of a portable crushing apparatus 100, in accordance with one embodiment of the present invention.

The portable crushing apparatus 100 includes a pair of handles 120, a pair of arms 130, a casing 140 and a cover 150. The handles 120 are perpendicular to the portable crushing apparatus 100 and allow a user to grasp the portable crushing apparatus 100 while in use. The arms 130 include a distal end 132 on each arm 130 and extend horizontally from the portable crushing apparatus 100. The handles 120 are perpendicularly attached to the distal end 132 of the arms 130. The casing 140 includes a top 142 and houses a crushing assembly 200 that is housed within the casing 140 that is described and illustrated in greater detail in FIGS. 2A and 2B and their descriptions. The support legs 110 are angled at a similar angle as the casing 140. The cover 150 is swingably openable and disposed on the top 142 of the casing 140 and are straight in relation to the casing 140.

Figure 1C:
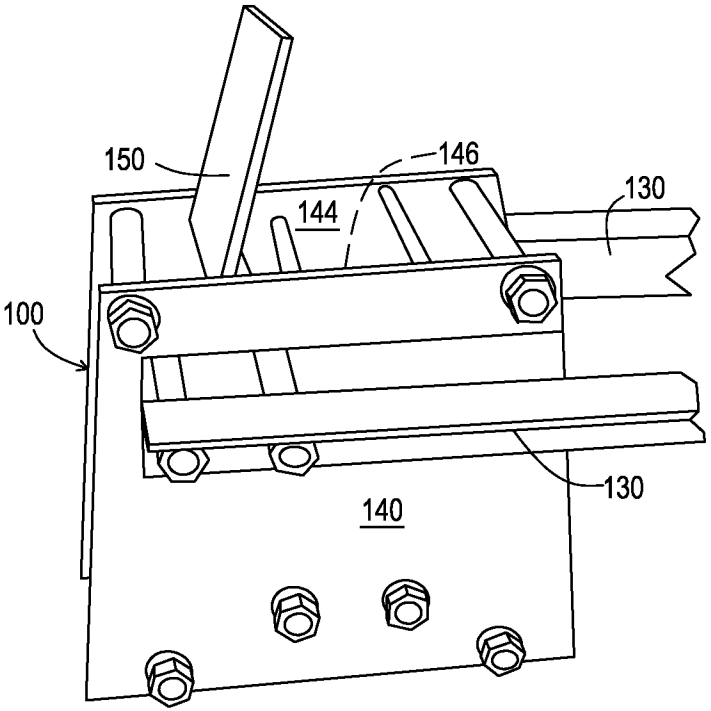
FIG. 1C illustrates a side perspective view of a portable crushing apparatus, in accordance with one embodiment of the present invention.

FIG. 1C illustrates a side perspective view of a portable crushing apparatus 100, in accordance with one embodiment of the present invention. The portable crushing apparatus 100 illustrated in FIG. 1B has the cover 150 in a partially open position to allow a user to deposit relatively small rocks and ores to be crushed by the portable crushing apparatus 100. The casing 140 of the portable crushing apparatus 100 also includes a left side plate 144 and a right side plate 146 disposed within the casing 140.

Figure 2A:
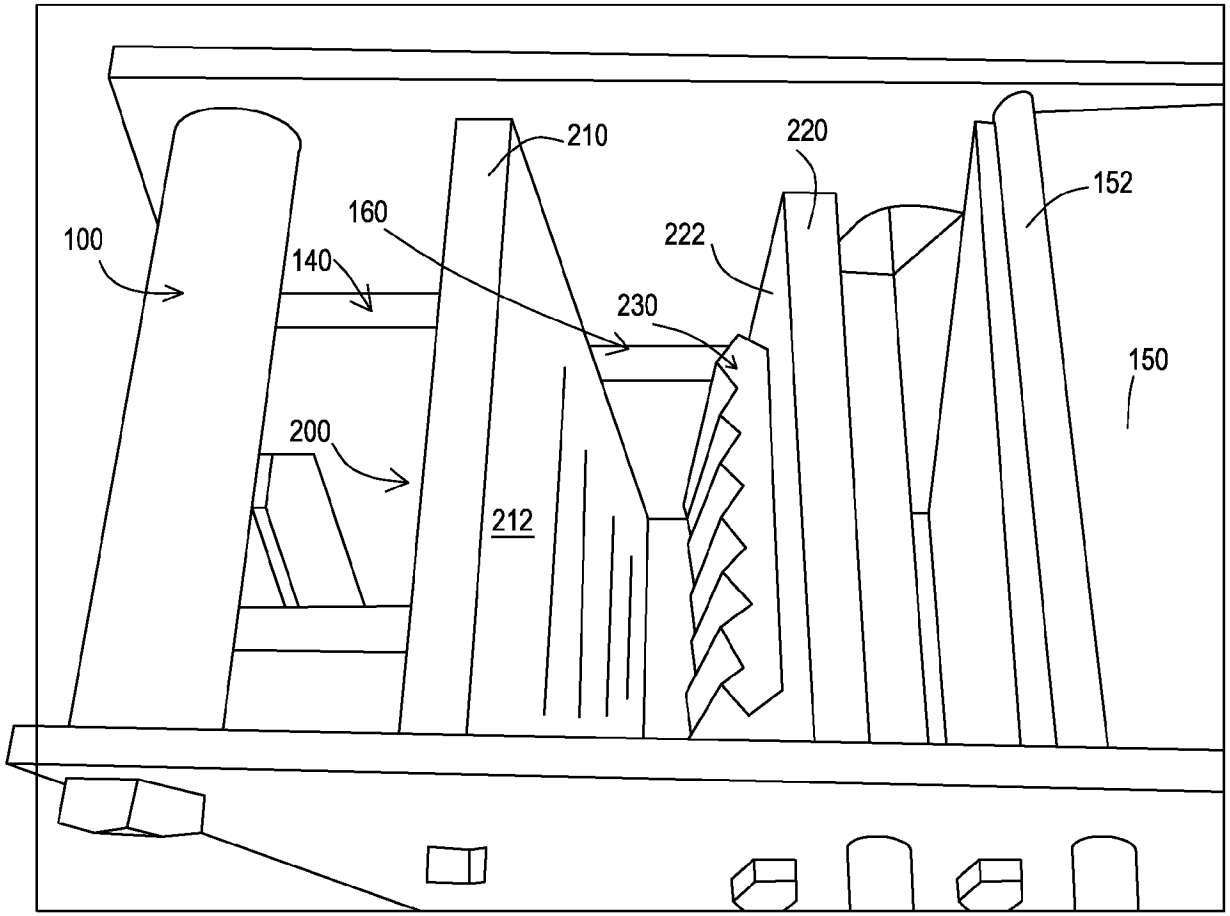
FIG. 2A illustrates a top perspective view of a crushing assembly of a portable crushing apparatus, in accordance with one embodiment of the present invention.

FIG. 2A illustrates a top perspective view of a crushing assembly 200 of a portable crushing apparatus 100, in accordance with one embodiment of the present invention. As previously indicated the crushing assembly 200 is housed within the casing 140 of the portable crushing apparatus 100. The cover 150 is swung in a fully open position as illustrated in FIG. 2A and is swingably pivoted by a cover pin 152 that runs across an opening 160 formed from swingably opening the cover 150, accessing the crushing assembly 200.

The crushing assembly 200 includes an adjustable jaw 210, a movable jaw 220 and a plurality of jaw teeth 230. The adjustable jaw 210 has a front facing 212 and is disposed vertically within the casing 140. The movable jaw 220 also has a front facing 222 and is disposed vertically within the casing 140. The jaw teeth 230 are disposed on the front facing 222 of the movable jaw 220. The adjustable jaw 210 and the movable jaw 220 with jaw teeth 230 form the opening 160 to allow a user to deposit relatively small rocks and ores to be crushed by the adjustable jaw 210 and the movable jaw 220 with jaw teeth 230 forceably coming together to crush the deposited relatively small rocks and ores. The movable jaw 220 slides up and down against the bottom forward edge of the adjustable jaw 210, thus allowing for the material to be ground finer with each pass.

Figure 2B:
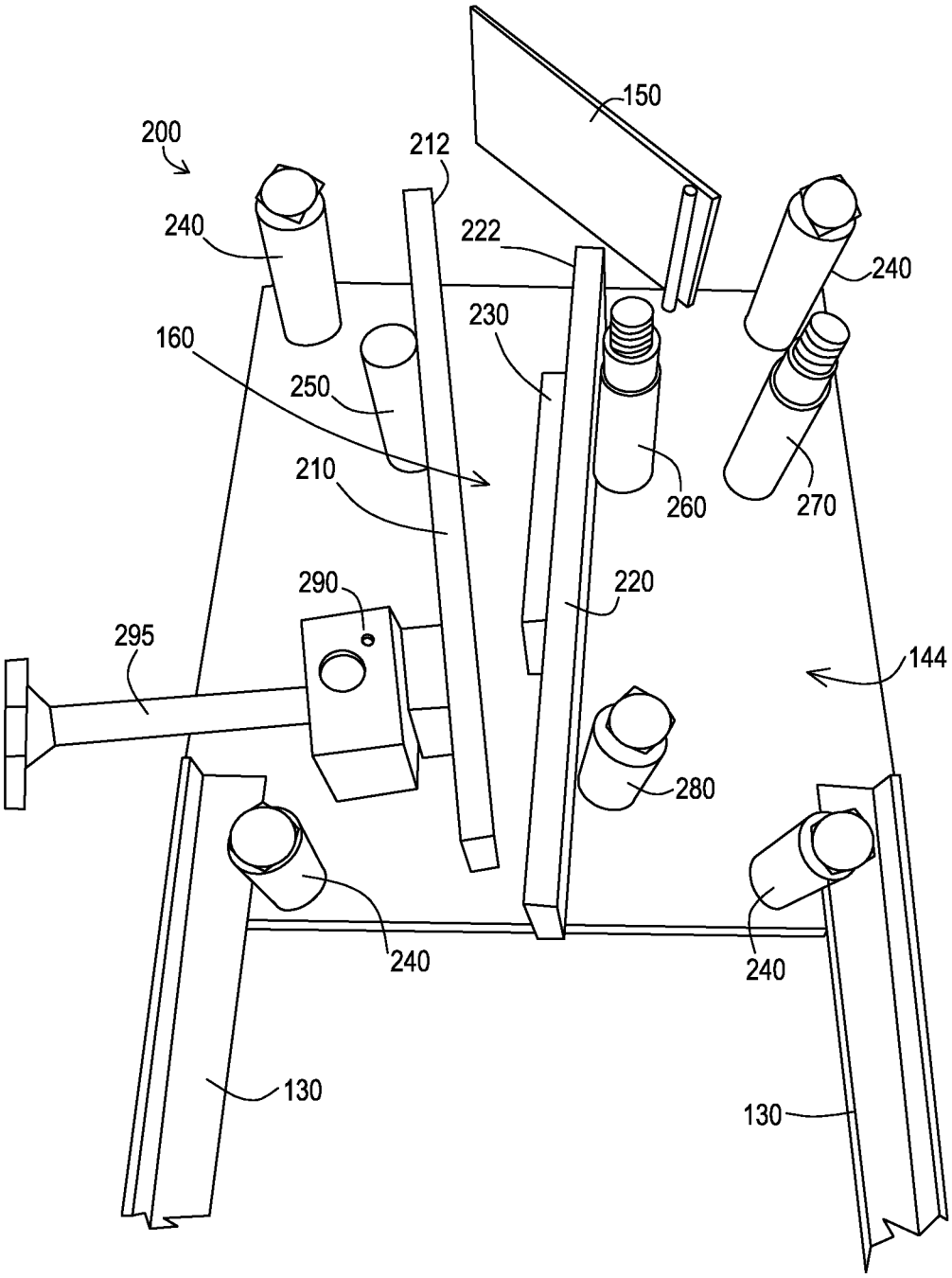
FIG. 2B illustrates a front perspective view of a crushing assembly of a portable crushing apparatus, in accordance with one embodiment of the present invention.

FIG. 2B illustrates a front perspective view of a crushing assembly 200 of a portable crushing apparatus 100, in accordance with one embodiment of the present invention.

The crushing assembly 200 includes the adjustable jaw 210, the movable jaw 220 and the plurality of jaw teeth 230 previously described and illustrated in FIG. 2A and its description. The crushing assembly 200 also includes a plurality of spacers 240, an adjustable jaw pin 250, a guide pin 260, a pivot pin 270, a movable jaw spacer 280, an adjuster bracket 290 and an adjusting bolt 295. The spacers 240 provided are disposed on the left side plate 144 previously described in FIG. 1B in each corner 145 of the left side plate 144. The adjustable jaw pin 250 adjusts a position of the adjustable jaw 210 and is disposed behind a top portion 214 of the adjustable jaw 210. The adjustable jaw pin 250 can also protrude through the right side plate 146 and be adjusted from exterior the portable crushing apparatus 100. The guide pin 260 is disposed behind a top portion 262 of the movable jaw 220 to guide the movable jaw 220. The guide pin 260 can also protrude through the right side plate 146 and be adjusted from exterior the portable crushing apparatus 100. The pivot pin 270 is disposed behind the guide pin 260 and positions the crushing assembly 200. The pivot pin 270 can also protrude through the right side plate 146 and be adjusted from exterior the portable crushing apparatus 100 as well. The movable jaw spacer 280 is disposed behind a bottom portion 226 of the movable jaw 220 and works in combination with the guide pin 260 to position the movable jaw 220. The adjuster bracket 290 is disposed behind the bottom portion 292 of the adjustable jaw 210 and works in combination with the adjustable jaw pin 250 to position the adjustable jaw 210. The adjusting bolt 295 is an elongated stem that is attached to the adjuster bracket 290 to manually control the adjuster bracket 290.

Figure 3:
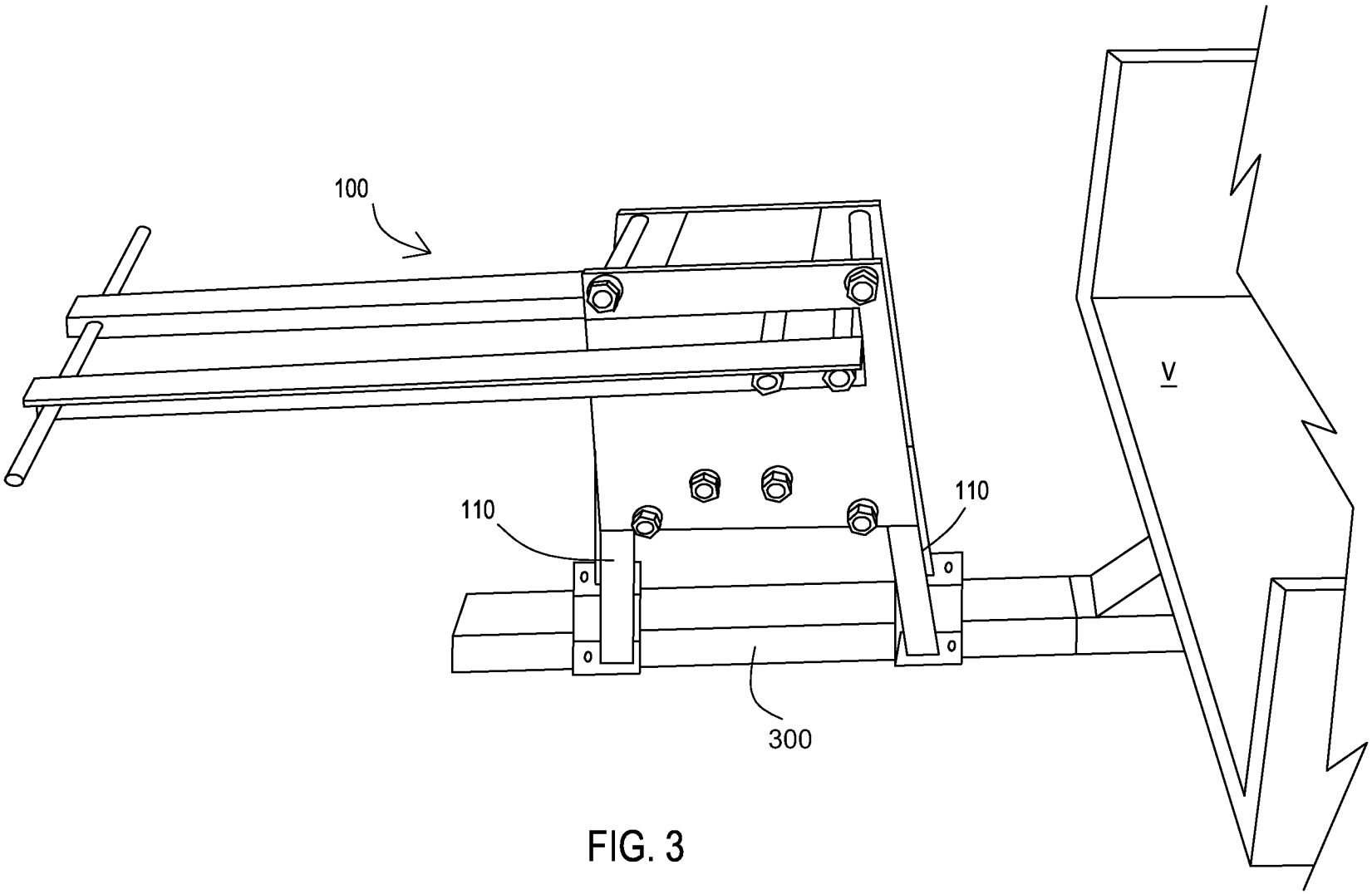
FIG. 3 illustrates a side perspective view of a portable crushing apparatus attached to a trailer of a vehicle, in accordance with one embodiment of the present invention.

FIG. 3 illustrates a side perspective view of a portable crushing apparatus 100 attached to a trailer 300 of a vehicle V, in accordance with one embodiment of the present invention. The portable crushing apparatus 100 is raised and stabilized by a plurality of support legs 110 that are perpendicularly attached to a trailer 300 that is attached to a vehicle V. The trailer 300 and vehicle V can be any suitable trailer and vehicle such as an automobile, a pick-up truck or a commercial truck. The portable crushing apparatus 100 includes the similar features to the portable crushing apparatus 100 illustrated and described in FIGS. 1A, 1B, 2A and 2B.

The manually operated portable jaw crusher is hand operated and portable, allowing it to be used in the field where there is no electricity and no need to carry fuel to operate it. It is also usable in a laboratory setting. Its purpose is to provide a capability of both crushing a plurality of relatively small rocks and ores, and grinding the relatively small ores or rocks to an approximate minus 20 mesh in three or less passes through the manually operated portable jaw crusher. It is very suitable for use in remote areas as it is light enough to be packed into an area where ore discovery is typically allowed, but not allowed to run mechanical devices with a fuel operating device, such as in forested or wooded areas in a dry season. There is no chance of a spark catching dry organic materials on fire when utilizing the manually operated portable jaw crusher. The manually operated portable jaw crusher is operated with a simple leveling system, whereby the movable jaw is attached to a non-rotating shaft, and as the arms are moved-up and down, the shaft that the jaw is attached to moves up and down with the arms. The movable jaw shaft follows an arc path up and back, then forward and down. This movable jaw shaft is in a radius with the pivot shaft and rotates in position as the handle is raised or lowered. The lower portion of the movable jaw rests and slides up and down on another shaft with a sleeve on it. The other jaw, normally called the stationary jaw is adjustable. There is an adjuster bracket that the stationary jaw rests against when the crusher is in its fully opened state. The top of the stationary jaw is attached to a shaft that just rotates slightly with the movement of the adjuster. The stationary jaw is adjusted with the use of an approximate ½"×5" bolt, where turning the bolt inward moves the stationary jaw closer to the movable jaw, decreasing the lower gap for a smaller output of crushed rock or ore. The manually operated portable jaw crusher is designed to be fully closed, where both jaws intersect and touch at the very bottom of the stationary jaw, and the movable jaw slides up and down against the bottom forward edge of the stationary jaw, thus allowing for the material to be ground finer with each pass. By raising and lowering the handle, the movable jaw shaft follows the arc up and down, whereas other traditional jaw crushers have a fully rotating concentric shaft. The relatively long handles, and the relatively short distance between the pivot shaft and the movable jaw shaft allows for a relatively greater quantity of pressure to be exerted against the rock and/or ore. The manually operated portable jaw crusher has an optional hitch mount whereas the hitch mount is designed specifically for use with the manually operated portable jaw crusher. The crusher is bolted or clamped to the mount, and the mount is designed to fit any approximately two inch receiver hitch on the back of a vehicle.

The manually operated portable jaw crusher is an inexpensive method and effective method of crushing ore samples while out in the field for testing on-site. The manually operated portable jaw crusher needs to be mounted on any solid surface to limit movement of the manually operated portable jaw crusher. The feet of the manually operated portable jaw crusher have a plurality of mounting holes so the crusher can be bolted or clamped down to a sturdy table, or a tree stump. It can also be mounted to two pieces of lumber, extending outward and a vehicle can be driven on to the extended lumber pieces to anchor the manually operated portable jaw crusher. The manually operated portable jaw crusher can be used by geologists in the performance of their duties in the field, as well as in the lab. The manually operated portable jaw crusher can be used to crush down and recycle used ceramic computer CPU chips to liberate the gold plating and other precious metals contained within. The manually operated portable jaw crusher can also be used by craftsmen and artisans who desire to break but not crush minerals, stones, rocks etc., for the purpose of art work, or that of tumbling and polishing stones.

The manually operated portable jaw crusher is comprised of two side plates, cut at a taper towards the top of the manually operated portable jaw crusher. They are held apart at a distance of approximately four inches by the use of five spacers, whereby approximate ½"×5" bolts are inserted. The movable and the adjustable jaw plates are both approximately four inches wide by approximately eight inches long. The adjustable jaw is mounted from the top by a shaft that expands across the width of the manually operated portable jaw crusher, and the shaft is allowed to rotate in place. The manually operated portable jaw crusher is mounted towards the top with a shaft that extends beyond the width of the manually operated portable jaw crusher, and the arms are attached to the ends of the movable jaw shaft. There is a curved slot in which the movable jaw shaft fits though the sides of the plates, that is in relationship to the curve of the radius of the pivot shaft. The pivot shaft is mounted across the width of the manually operated portable jaw crusher, and extends outward on both sides, whereas the second hole in the arms are attached. There is a cover plate as a safety issue, to prevent chips of rock from flying up and out while rock and ore are being broken. The feet are drilled and able to mount to most any sturdy surface for use. It can also be mounted to an optional hitch mount, whereas the hitch mount is designed specifically for use with the manually operated portable jaw crusher. The manually operated portable jaw crusher is bolted or clamped to the mount, and the mount is designed to fit any approximate two inch receiver hitch on the back of a vehicle. The adjuster is a bracket bolted to both inner sides of the side plates, whereas the adjustable jaw rests up against the bracket in the fully open position. It includes a bolt that turns to move the jaw in or out, thus decreasing or increasing the output gap.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A portable crushing apparatus to crush and grind a plurality of small rocks and ores, comprising:

a plurality of support legs that raise and stabilize said portable crushing apparatus;

a pair of handles that are perpendicular to said portable crushing apparatus and allow a user to grasp said portable crushing apparatus while in use;

a pair of arms that include a distal end on each said arm and extend horizontally from said portable crushing apparatus;

a casing that includes a top, a left side plate and a right side plate and houses a crushing assembly that includes an adjustable jaw, a movable jaw, a plurality of jaw teeth, a plurality of spacers, an adjustable jaw pin, a guide pin, a pivot pin, a movable jaw spacer, an adjuster bracket and an adjusting bolt that is housed within said casing, said adjustable jaw pin protrudes through said right side plate and is adjusted from exterior said portable crushing apparatus; and a cover that is swingably openable and disposed on said top of said casing to prevent flying debris from said small rocks and ores during crushing or grinding.

2. The apparatus according to claim 1, wherein said handles are perpendicularly attached to said distal end of said arms.

3. The apparatus according to claim 1, wherein said adjustable jaw has a front facing and is disposed vertically within said casing.

4. The apparatus according to claim 1, wherein said movable jaw has a front facing and is disposed vertically within said casing.

5. The apparatus according to claim 1, wherein said adjustable jaw and said movable jaw with said jaw teeth form said opening to allow said user to deposit said small rocks and ores to be crushed by said adjustable jaw and said movable jaw with said jaw teeth forceably coming together to crush said deposited small rocks and ores.

6. The apparatus according to claim 1, wherein said movable jaw slides up and down against a bottom forward edge of said adjustable jaw allowing said small rocks and ores to be ground finer with each pass through said portable crushing apparatus.

7. The apparatus according to claim 1, wherein said spacers are disposed on said left side plate in each corner of said left side plate.

8. The apparatus according to claim 1, wherein said adjustable jaw pin adjusts a position of said adjustable jaw and is disposed behind a top portion of said adjustable jaw.

9. The apparatus according to claim 1, wherein said guide pin is disposed behind a top portion of said movable jaw to guide said movable jaw.

10. The apparatus according to claim 1, wherein said guide pin protrudes through said right side plate and is adjusted from exterior said portable crushing apparatus.

11. The apparatus according to claim 1, wherein said pivot pin is disposed behind said guide pin and positions said crushing assembly.

12. The apparatus according to claim 1, wherein said pivot pin protrudes through said right side plate and is adjusted from exterior said portable crushing apparatus.

13. The apparatus according to claim 1, wherein said movable jaw spacer is disposed behind a bottom portion of said movable jaw and works in combination with said guide pin to position said movable jaw.

14. The apparatus according to claim 1, wherein said adjuster bracket is disposed behind said bottom portion of said adjustable jaw and works in combination with said adjustable jaw pin to position said adjustable jaw.

15. The apparatus according to claim 1, wherein said adjusting bolt is an elongated stem that is attached to said adjuster bracket to manually control said adjuster bracket.

16. The apparatus according to claim 1, wherein said cover is in a partially open position to allow said user to deposit said small rocks and ores to be crushed by said portable crushing apparatus.

17. The apparatus according to claim 1, wherein said cover is in a fully open position to allow said user to deposit said small rocks and ores to be crushed by said portable crushing apparatus.

18. The apparatus according to claim 1, wherein said portable crushing apparatus is raised and stabilized by said support legs that are perpendicularly attached to a trailer that is attached to a vehicle.

19. The apparatus according to claim 18, wherein said vehicle is an automobile, a pick-up truck or a commercial truck.

20. A portable crushing apparatus to crush and grind a plurality of small rocks and ores, comprising:

a plurality of support legs that raise and stabilize said portable crushing apparatus;

a pair of handles that are perpendicular to said portable crushing apparatus and allow a user to grasp said portable crushing apparatus while in use;

a pair of arms that include a distal end on each said arm and extend horizontally from said portable crushing apparatus;

a casing that includes a top, a left side plate and a right side plate and houses a crushing assembly that includes an adjustable jaw, a movable jaw, a plurality of jaw teeth, a plurality of spacers, an adjustable jaw pin, a guide pin, a pivot pin, a movable jaw spacer, an adjuster bracket and an adjusting bolt that is housed within said casing, wherein said guide pin protrudes through said right side plate and is adjusted from exterior said portable crushing apparatus; and a cover that is swingably openable and disposed on said top of said casing to prevent flying debris from said small rocks and ores during crushing or grinding.

21. The apparatus according to claim 20, wherein said handles are perpendicularly attached to said distal end of said arms.

22. The apparatus according to claim 20, wherein said adjustable jaw has a front facing and is disposed vertically within said casing.

23. The apparatus according to claim 20, wherein said movable jaw has a front facing and is disposed vertically within said casing.

24. The apparatus according to claim 20, wherein said adjustable jaw and said movable jaw with said jaw teeth form said opening to allow said user to deposit said small rocks and ores to be crushed by said adjustable jaw and said movable jaw with said jaw teeth forceably coming together to crush said deposited small rocks and ores.

25. The apparatus according to claim 20, wherein said movable jaw slides up and down against a bottom forward edge of said adjustable jaw allowing said small rocks and ores to be ground finer with each pass through said portable crushing apparatus.

26. The apparatus according to claim 20, wherein said spacers are disposed on said left side plate in each corner of said left side plate.

27. The apparatus according to claim 20, wherein said adjustable jaw pin adjusts a position of said adjustable jaw and is disposed behind a top portion of said adjustable jaw.

28. The apparatus according to claim 20, wherein said adjustable jaw pin protrudes through said right side plate and is adjusted from exterior said portable crushing apparatus.

29. The apparatus according to claim 20, wherein said guide pin is disposed behind a top portion of said movable jaw to guide said movable jaw.

30. The apparatus according to claim 20, wherein said pivot pin protrudes through said right side plate and is adjusted from exterior said portable crushing apparatus.

31. The apparatus according to claim 20, wherein said movable jaw spacer is disposed behind a bottom portion of said movable jaw and works in combination with said guide pin to position said movable jaw.

32. The apparatus according to claim 20, wherein said adjuster bracket is disposed behind said bottom portion of said adjustable jaw and works in combination with said adjustable jaw pin to position said adjustable jaw.

33. The apparatus according to claim 20, wherein said adjusting bolt is an elongated stem that is attached to said adjuster bracket to manually control said adjuster bracket.

34. The apparatus according to claim 20, wherein said cover is in a partially open position to allow said user to deposit said small rocks and ores to be crushed by said portable crushing apparatus.

35. The apparatus according to claim 20, wherein said cover is in a fully open position to allow said user to deposit said small rocks and ores to be crushed by said portable crushing apparatus.

36. The apparatus according to claim 20, wherein said portable crushing apparatus is raised and stabilized by said support legs that are perpendicularly attached to a trailer that is attached to a vehicle.

37. The apparatus according to claim 36, wherein said vehicle is an automobile, a pick-up truck or a commercial truck.

38. A portable crushing apparatus to crush and grind a plurality of small rocks and ores, comprising:

a plurality of support legs that raise and stabilize said portable crushing apparatus;

a pair of handles that are perpendicular to said portable crushing apparatus and allow a user to grasp said portable crushing apparatus while in use;

a pair of arms that include a distal end on each said arm and extend horizontally from said portable crushing apparatus;

a casing that includes a top, a left side plate and a right side plate and houses a crushing assembly that includes an adjustable jaw, a movable jaw, a plurality of jaw teeth, a plurality of spacers, an adjustable jaw pin, a guide pin, a pivot pin, a movable jaw spacer, an adjuster bracket and an adjusting bolt that is housed within said casing, wherein said pivot pin protrudes through said right side plate and is adjusted from exterior said portable crushing apparatus; and a cover that is swingably openable and disposed on said top of said casing to prevent flying debris from said small rocks and ores during crushing or grinding.

39. The apparatus according to claim 38, wherein said handles are perpendicularly attached to said distal end of said arms.

40. The apparatus according to claim 38, wherein said adjustable jaw has a front facing and is disposed vertically within said casing.

41. The apparatus according to claim 38, wherein said movable jaw has a front facing and is disposed vertically within said casing.

42. The apparatus according to claim 38, wherein said adjustable jaw and said movable jaw with said jaw teeth form said opening to allow said user to deposit said small rocks and ores to be crushed by said adjustable jaw and said movable jaw with said jaw teeth forceably coming together to crush said deposited small rocks and ores.

43. The apparatus according to claim 38, wherein said movable jaw slides up and down against a bottom forward edge of said adjustable jaw allowing said small rocks and ores to be ground finer with each pass through said portable crushing apparatus.

44. The apparatus according to claim 38, wherein said spacers are disposed on said left side plate in each corner of said left side plate.

45. The apparatus according to claim 38, wherein said adjustable jaw pin adjusts a position of said adjustable jaw and is disposed behind a top portion of said adjustable jaw.

46. The apparatus according to claim 38, wherein said adjustable jaw pin protrudes through said right side plate and is adjusted from exterior said portable crushing apparatus.

47. The apparatus according to claim 38, wherein said guide pin is disposed behind a top portion of said movable jaw to guide said movable jaw.

48. The apparatus according to claim 38, wherein said pivot pin protrudes through said right side plate and is adjusted from exterior said portable crushing apparatus.

49. The apparatus according to claim 38, wherein said guide pin protrudes through said right side plate and is adjusted from exterior said portable crushing apparatus.

50. The apparatus according to claim 38, wherein said pivot pin is disposed behind said guide pin and positions said crushing assembly.

51. The apparatus according to claim 38, wherein said movable jaw spacer is disposed behind a bottom portion of said movable jaw and works in combination with said guide pin to position said movable jaw.

52. The apparatus according to claim 38, wherein said adjuster bracket is disposed behind said bottom portion of said adjustable jaw and works in combination with said adjustable jaw pin to position said adjustable jaw.

53. The apparatus according to claim 38, wherein said adjusting bolt is an elongated stem that is attached to said adjuster bracket to manually control said adjuster bracket.

54. The apparatus according to claim 38, wherein said cover is in a partially open position to allow said user to deposit said small rocks and ores to be crushed by said portable crushing apparatus.

55. The apparatus according to claim 38, wherein said cover is in a fully open position to allow said user to deposit said small rocks and ores to be crushed by said portable crushing apparatus.

56. The apparatus according to claim 38, wherein said portable crushing apparatus is raised and stabilized by said support legs that are perpendicularly attached to a trailer that is attached to a vehicle.

57. The apparatus according to claim 56, wherein said vehicle is an automobile, a pick-up truck or a commercial truck.

* * * * *